US006436011B1

(12) United States Patent
Cook

(10) Patent No.: US 6,436,011 B1
(45) Date of Patent: Aug. 20, 2002

(54) EXERCISE HARNESS FOR USE WITH UNWEIGHTING APPARATUS

(76) Inventor: Gerry Cook, 3115 N. Boyer Ave., Sandpoint, ID (US) 83864

( * ) Notice: Subject to any disclaimer, the term of this patent is extended or adjusted under 35 U.S.C. 154(b) by 0 days.

(21) Appl. No.: 09/880,686

(22) Filed: Jun. 12, 2001

Related U.S. Application Data

(60) Provisional application No. 60/210,971, filed on Jun. 12, 2000.

(51) Int. Cl.[7] ..... A63B 7/00

(52) U.S. Cl. ..... 482/69; 128/875; 2/311; 119/770

(58) Field of Search ..... 482/69, 124, 66, 482/143, 121; 602/4, 5, 19, 60–62; 128/875, 876, 869; 2/311, 312; 182/3; 434/255; 224/222, 660–611; 119/770, 700, 702, 712, 907

(56) References Cited

U.S. PATENT DOCUMENTS 3,780,663 A * 12/1973 Pettit ..... 104/307
5,080,191 A * 1/1992 Sanchez ..... 182/3
5,203,754 A * 4/1993 Maclean ..... 482/121
5,498,219 A * 3/1996 Soufi ..... 434/255
5,662,560 A * 9/1997 Svendsen et al. ..... 482/54
5,993,362 A * 11/1999 Ghobadi ..... 482/121

* cited by examiner

*Primary Examiner*—Denise M. Pothier
*Assistant Examiner*—Quang D. Thanh
(74) *Attorney, Agent, or Firm*—Richard C. Conover

(57) ABSTRACT

An exercise harness connected to an unweighting system with shoulder straps. The exercise harness having a waist belt suspended by the shoulder straps which belt may be secured to a user. The exercise harness further having left and right legs or knee bands connected to the waist strap with a left front strap and a right front strap, respectively. A strap is provided forming a sliding "W" connection between the waist belt and the two leg bands to allow for freedom of leg movement when walking, running or jogging. The exercise harness is also provided with a gait modification strap having one end secured to the waist belt and the other end secured to one of the leg bands after wrapping the gait strap partially around a leg of the user.

5 Claims, 4 Drawing Sheets

EXERCISE HARNESS FOR USE WITH UNWEIGHTING APPARATUS

This application claims the benefit of U.S. provisional application No. 60/210,971, filed Jun. 12, 2000.

BACKGROUND OF INVENTION

This invention relates to an exercise harness for use by an individual when using an unweighting system. The invention has particular application when used in conjunction with a treadmill where a user is either walking or jogging or running on the treadmill at the same time being supported by an unweighting system.

The use of a body harness with unweighting systems is known. See U.S. Pat. No. 2,719,568 to Webb; U.S. Pat. No. 3,780,663 to Pettit; U.S. Pat. No. 4,410,175 to Shamp; and U.S. Pat. No. 5,662,560 to Svendsen et al. All of these patents show a waist belt for securing the harness to a user's body. It has been found that when leg bands secured to the waist belt are used, that the user is better stabilized and that the waist belt will not ride up on the user's waist as much when the user is exercising. U.S. Pat. No. 3,780,663 and U.S. Pat. No. 4,410,175 show leg bands connected to a waist belt for this additional stability.

A problem with these known harnesses incorporating a waist belt and leg bands is that the user has difficulty walking, jogging or running when using these harnesses connected to an unweighting system. The straps connecting the leg bands to the waist belt do not accommodate the different lengths between the waist belt and the leg bands when one leg is moved forward of the other.

A need exists for an exercise harness which can be used during therapy in conjunction with a treadmill and an unweighting system to allow a user to either walk, jog or run on the treadmill while being partially suspended by an unweighting system.

Another problem with existing exercise harnesses is that there are none available which can be used in therapy to correct gait problems which a patient may have. For example, a patient may have a gait with external rotation or internal rotation. Further, the patient may be bow-legged and have a varus gait, or the person may be knock-kneed and have a valgus gait. What is needed is an exercise harness which can be used to correct these gait problems during therapy sessions.

SUMMARY OF INVENTION

An exercise harness for use with an unweighting system having a pair of shoulder straps connecting the exercise harness the unweighting system. The exercise harness having a waist belt suspended by the shoulder straps. The belt is provided with a buckle for releasably securing the ends of the belt together. The exercise harness further includes a left leg band and a right leg band with the leg or knee bands being connected to the waist strap with a left front strap and a right front strap, respectively. A sliding strap is provided having one end buckled to the waist belt above a left leg band, and the free end threaded through a "D"-ring secured to the left leg band and through a "D"-ring secured to the waist belt at a medial position between the ends of the waist belt, and then through a "D"-ring secured to the right leg band and through a buckle secured to the waist belt above the right leg band.

The present exercise harness is also provided with a gait modification strap having one end secured to the waist belt and the other end secured to one of the leg bands after wrapping the gait strap partially around a leg of the user. The gait strap being used for correcting gait problems of a user.

BRIEF DESCRIPTION OF THE DRAWINGS

In order that the invention may be clearly understood and readily carried into effect, a preferred embodiment of the invention will now be described, by way of example only, with reference to the accompanying drawings wherein.

DESCRIPTION OF A PREFERRED EMBODIMENT

Figure 1:
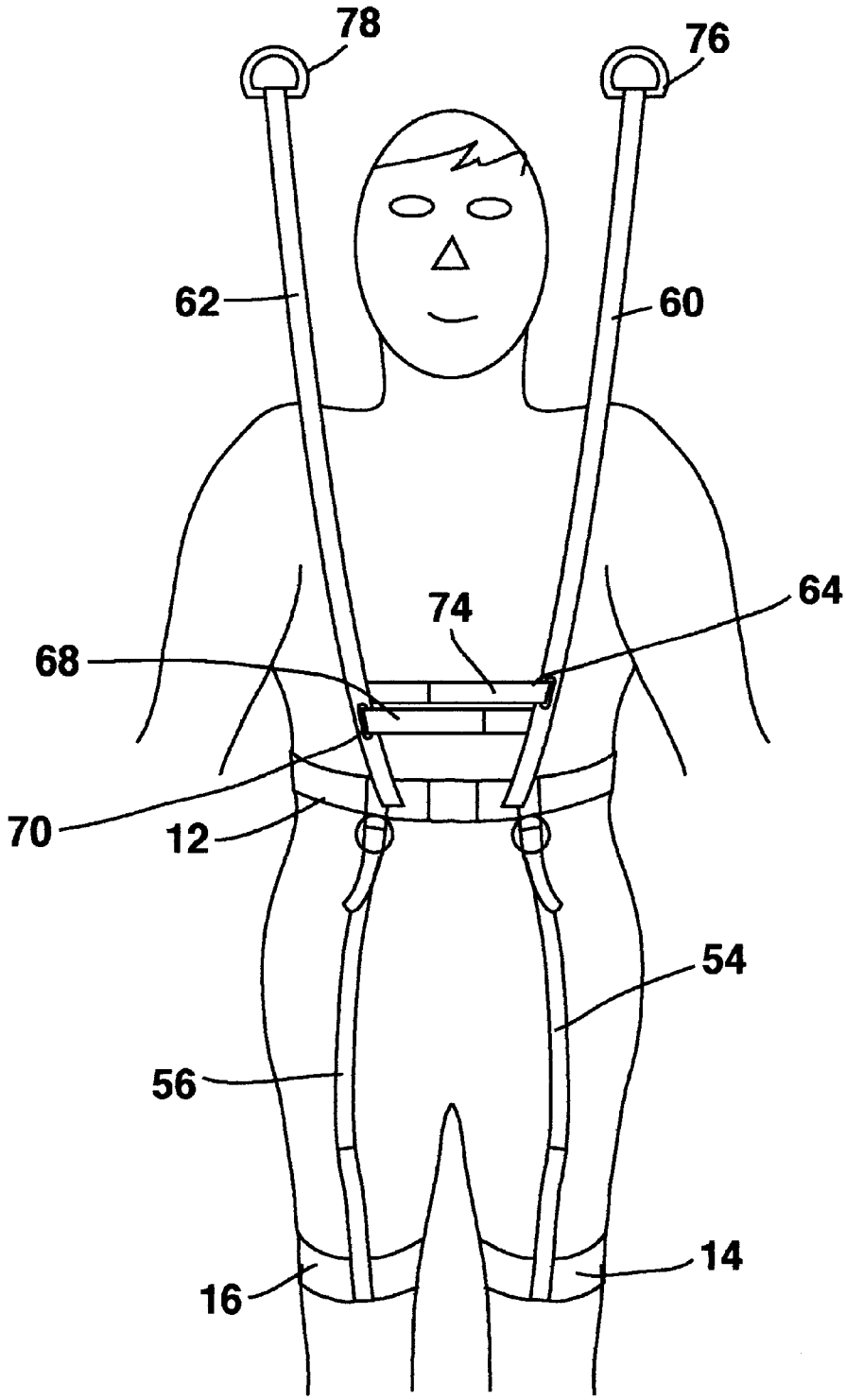
FIG. 1 is a front elevational view of an exercise harness according to the present invention installed on a user.
Figure 2:
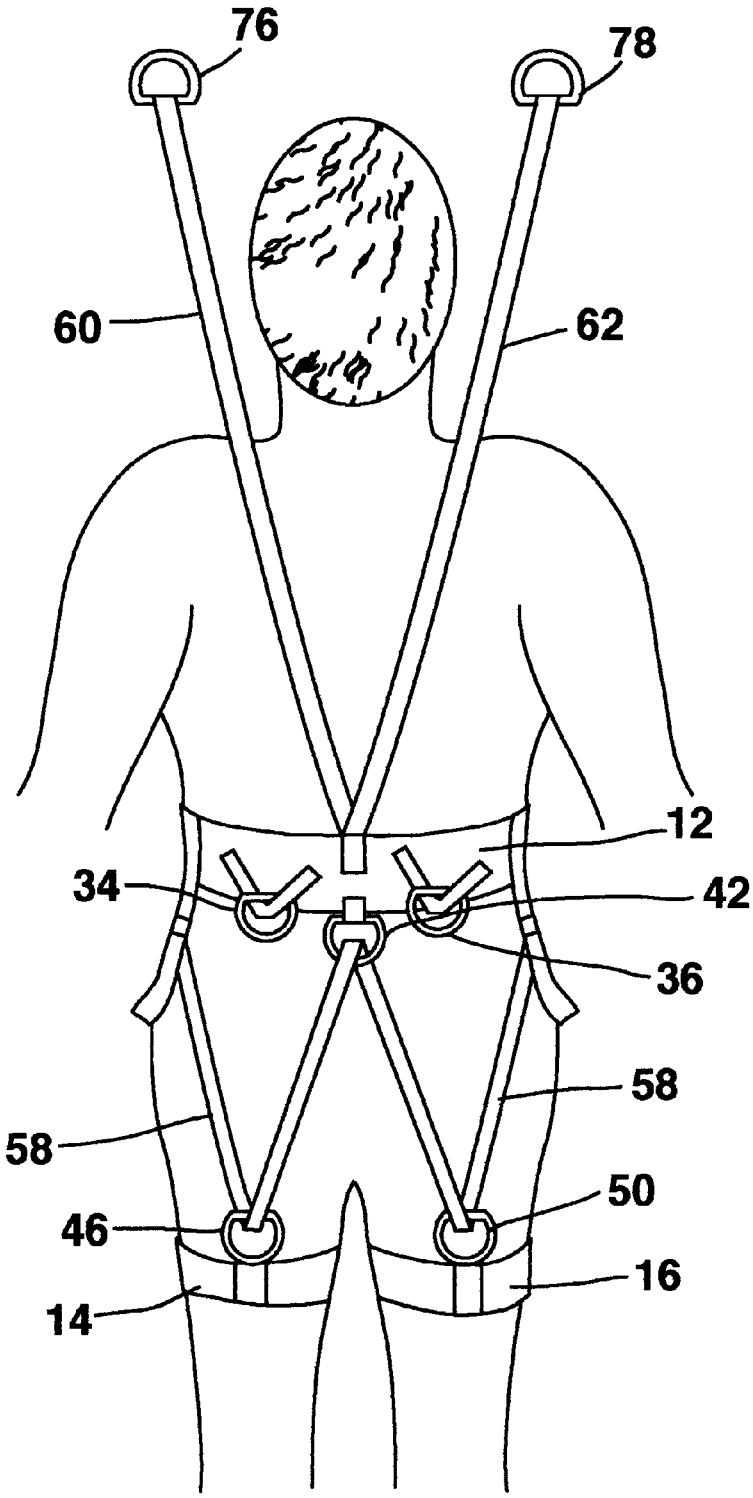
FIG. 2 is a rear elevational view of the exercise harness shown in FIG. 1 installed on a user.
Figure 3:
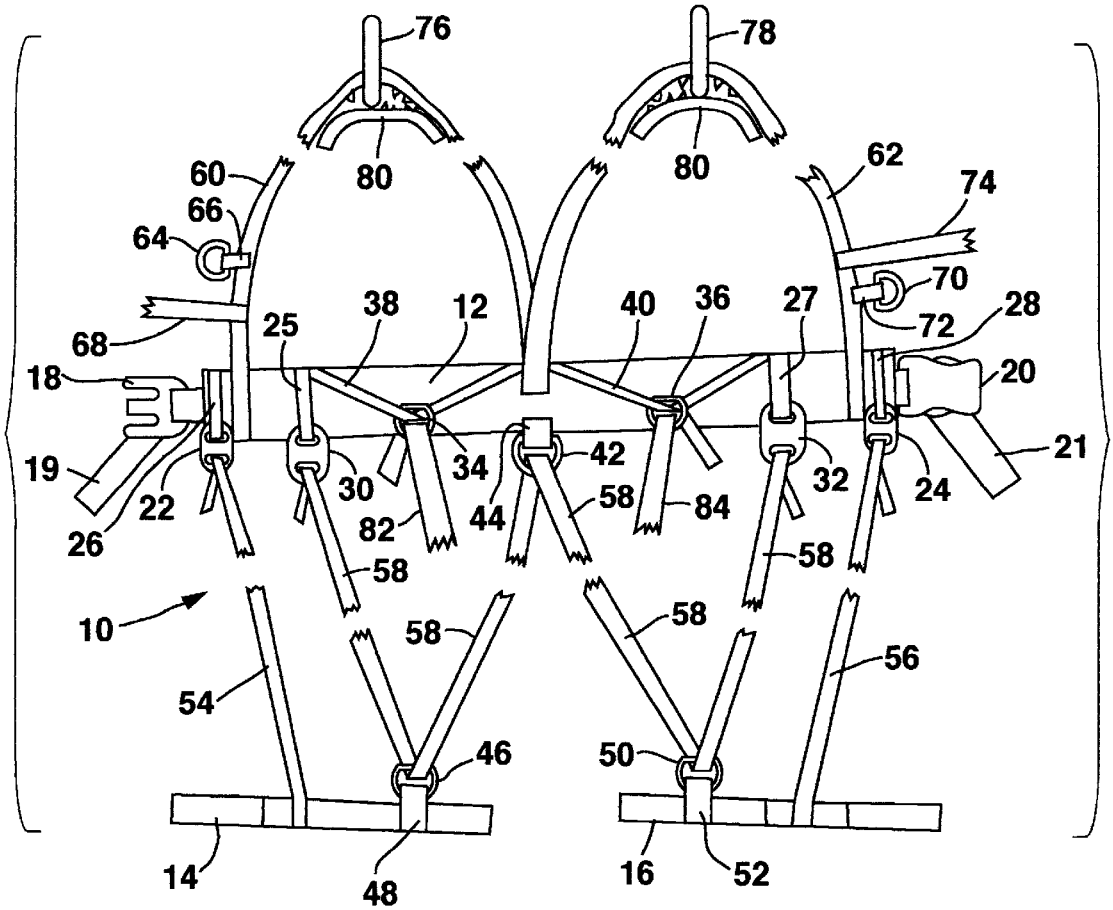
FIG. 3 is a front elevational view of the exercise harness according to the present invention before installation on a user.

An exercise harness according to the present invention is shown in FIGS. 1–3. The exercise harness 10 includes a waist belt 12 and a pair of leg or knee bands 14 and 16, as shown in FIG. 3. In a preferred embodiment, the waist belt 12 has its outer surface faced with a Velcro "loop" material (not shown). Further, in a preferred embodiment, the leg bands 14 and 16 each have an outer surface faced with a Velcro "loop" material (not shown) and an inner surface faced with a Velcro "hook" material (not shown).

The waist belt 12 includes a female buckle 18 and a male buckle 20 for connecting the waist belt 12 around a user's waist. The female buckle 18 is connected to belt 12 with a belt extension 19 sewn to belt 12, as shown in FIG. 3. Similarly, male buckle 20 is connected to belt 12 with a belt extension 21 sewn to belt 12.

A pair of front strap buckles 22 and 24 are sewn to waist belt 12 with straps 26 and 28, respectively. A pair of sliding strap buckles 30 and 32 are sewn to waist belt 12 with straps 25 and 27. A pair of D-rings 34 and 36 are sewn to waist belt 12 with reinforcing straps 38 and 40. The reinforcing strap 38 is threaded through D-ring 34 and has each of its ends sewn to belt 12. Similarly, reinforcing strap 40 is threaded through D-ring 34 and has each of its ends sewn to waist belt 12. A D-ring 42 is sewn to waist belt 12 with strap 44.

A D-ring 46 is sewn to leg strap 14 with strap 48. A D-ring 50 is sewn to leg strap 16 with strap 52.

A left front retaining strap 54 has one end sewn to leg strap 14, as shown in FIG. 3. The free end of strap 54 is threaded through buckle 22 sewn to belt 12. A right front retaining strap 56 is sewn to leg strap 16 and has its free end threaded through buckle 24 also sewn to belt 12. A sliding strap 58 has one end threaded through buckle 30. The strap is then threaded through D-ring 46, attached to the leg strap 14, and then up through D-ring 42, attached to waist belt 12, down through D-ring 50, attached to leg strap 16, and then upwardly through buckle 32 attached to waist belt 12.

A left shoulder strap 60 has one end sewn to waist belt 12 adjacent to buckle 22, as shown in FIG. 3, and has its other free end sewn to belt 12 adjacent to D-ring 42. A right shoulder strap 62 has one end sewn to belt 12 adjacent to buckle 20, and has its other end sewn to belt 12 adjacent to D-ring 42, as shown in FIG. 3. The left shoulder strap 60 has a D-ring 64 sewn to a strap 60 with a strap 66. A chest strap 68 has one end sewn to left shoulder strap 60. In a preferred embodiment, chest strap 68 has one side faced with Velcro "loop" material (not shown) and the other faced with Velcro "hook" material (not shown).

A D-ring 70 is sewn to right shoulder strap 62 with strap 72, and a chest strap 74 has one end sewn to right shoulder strap 62. In a preferred embodiment, chest strap 74 has one side faced with Velcro "loop" material (not shown) and has the other side faced with Velcro "hook" material (not shown).

A pair of D-rings 76 and 78 are provided for securing the exercise harness 10 to the unweighting apparatus. Shoulder strap 60 is threaded through D-ring 76 and shoulder strap 62 is threaded through D-ring 78.

Figure 4:
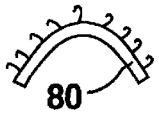
FIG. 4 is a detail view of a Velcro connector used with the present invention.
Figure 5:
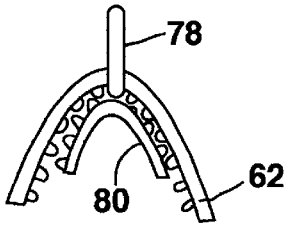
FIG. 5 is a detail view showing the Velcro connector shown in FIG. 4, installed on a shoulder strap.

A Velcro connector 80 is used to secure D-rings 76 and 78 in a selected position, as shown in FIG. 3. In a preferred embodiment, the strap 80 has a "hook" Velcro material on one face of the strap, as shown in FIG. 4. The shoulder straps 60 and 62 have a "loop" Velcro mate rial on the inner surface thereof, as shown in FIG. 5. When the D-rings 76 and 78 are located in their proper position, Velcro straps 80 are secured to the Velcro surface of straps 60 and 62, as shown in FIGS. 3 and 5. FIG. 5 shows the strap 80 with the right shoulder strap 62. Similarly, the strap 80 holds the D-ring of the left shoulder strap 60 in place.

The exercise harness described above is used by first attaching the D-rings 76 and 78 to an unweighting apparatus. The user then places the waist belt 12 around his waist, and snaps the buckles 18 and 20 together. Next, the chest strap 68 is drawn across the user's chest and threaded through the D-ring 70, and then looped back on itself and secured with a Velcro connection after being drawn snug. Next, the chest strap 74 is drawn across the user's chest and threaded through the D-ring 64, and again looped back on itself and connected with a Velcro connection after being drawn snug. Next, belt extensions 19 and 21 are then drawn snug to tighten the waist belt 12 against the user's waist. Next, the straps 54, 56 and 58 connecting the waist belt with the leg bands are loosened. The leg band 14 is then wrapped around the user's left leg above the knee, and the ends connected together with a Velcro connection. The leg band 16 is then wrapped around the user's right leg above the knee and the ends connected together with a Velcro connection. Next, the sliding strap 58 is drawn through either buckle 30 or buckle 32 to be snug against the user's buttocks, but not drawn too tight.

When the straps have all been connected as described above, the exercise harness 10 has now been fitted to the user. The user can now walk, jog or run on a treadmill with the unweighting apparatus reducing the weight of the person using the harness. The sliding strap 58 has the left leg loop between buckle 30 and D-ring 42 shortened as the right leg is being drawn forward, and the loop on the right leg between the D-ring 42 and the buckle 32 is caused to be larger, thus accommodating the walking, jogging, running movement of the user. Similarly, when the left leg moves forward, the loop between buckle 30 and D-ring 42 is made larger, and the loop between D-ring.42 and buckle 32 is made smaller.

The exercise harness 10 described above can also be used to correct for gait problems which a user may have. In correcting these problems, a gait strap 82 and a second gait strap 84 are used.

Figure 6:
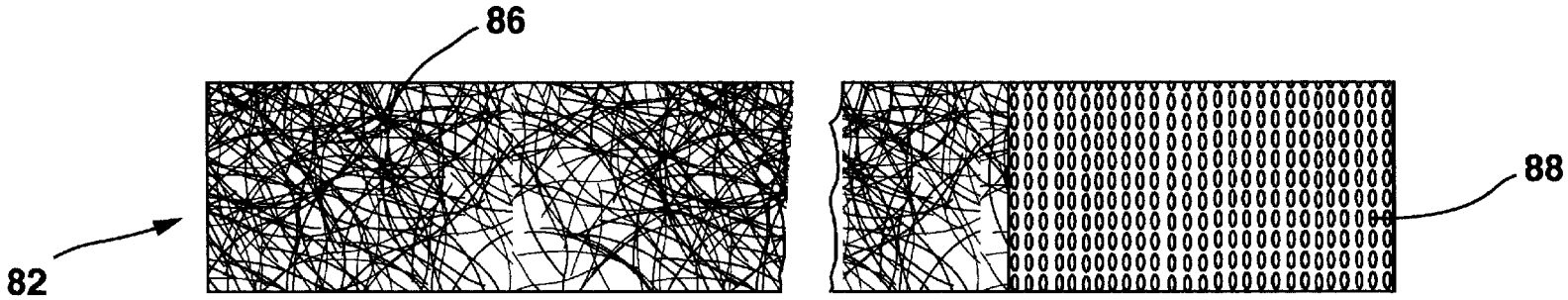
FIG. 6 is a top view of a gait strap used with the present invention.
Figure 7:
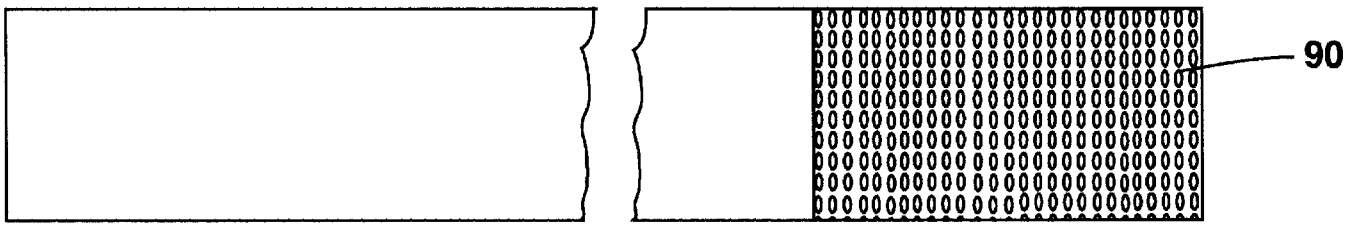
FIG. 7 is a bottom view of t he gait strap shown in FIG. 6.

Gait straps 82 and 84 are of similar construction with only gait strap 82 shown in detail in FIGS. 6 and 7. The gait strap 82 has one side faced with Velcro "loop" material 86, but has an end portion faced with Velcro "hook" material 88, as shown in FIG. 6. The reverse side of gait strap 82 is shown in FIG. 7. On this face, Velcro "hook" material 90 is sewn to strap 82, as shown.

The gait straps 82 and 84 are used differently for different types of gait modifications. For example, when a leg, such as the left leg is being corrected for external rotation, the gait strap 84 has one end Velcro fastened to the waist belt 12 on the right side of the user. The gait strap 84 is then drawn through the legs of the user and then downwardly in front of the leg to the left leg band 14, and is secured thereto by a Velcro connection after the gait strap is drawn snug. When the right leg is being corrected for external rotation, the gait strap 82 is used in a similar manner with the leg strap 84 being wrapped around the right leg.

When internal rotation of the right leg is being corrected, for example, the gait strap 82 is Velcro connected to waist band 12 on the left hand side of the user's waist, and then wrapped across the right buttock around the leg on the outside of the leg, and attached to the leg band 16 with a Velcro connection after being drawn snug. When the left leg has internal rotation, the gait strap 84 is used in a similar manner.

When a varus gait is being corrected, the gait strap 82 is looped through D-ring 34 and looped back on itself and connected thereto with a Velcro connection. The gait strap 82 is then drawn down between the legs of the user and wrapped around the front portion of the leg and connected to the right leg band 16 after being drawn snug. Similarly, the gait strap 84 is threaded through the D-ring 36, and looped back on itself and connected together with Velcro. The gait strap 84 is then drawn down between the legs of the user and around the left leg in front of the leg and connected with Velcro to the leg band 14 after being drawn snug.

When a valgus gait is to be corrected, the strap 82 is again threaded through D-ring 34 and looped back on itself and connected thereto with Velcro. The gait strap 82 is then drawn across the right buttock and around the outside of the leg and then down to the leg band 16 to which it is connected with Velcro after being drawn snug. Similarly, the gait strap 84 is threaded through D-ring 36 and attached to itself with Velcro, and then is drawn down across the left buttock and then around the outside of the leg, and then Velcro connected to the left leg band 14 after being drawn snug.

In using gait straps 82 and 84 with harness 10, a user suffering a gait problem can undergo therapy by walking on a treadmill while at the same time being partially suspended by unweighting apparatus.

While the fundamental novel features of the invention have been shown and described, it should be understood that various substitutions, modifications and variations may be made by those skilled in the art without departing from the spirit or scope of the invention. Accordingly, all such modifications or variations are included in the scope of the invention as defined by the following claims.

I claim:

1. An exercise harness for use with an unweighting system comprising:

a pair of shoulder straps for connecting to the unweighting system;

a waist belt having a buckle for releasably securing ends of the waist belt together;

the shoulder straps secured to the waist belt;

a left knee band and a right knee band;

a left front strap for connecting the left knee band to the waist belt;

a right front strap for connecting the right knee band to the waist belt;

a sliding strap having one end buckled to the waist belt above the left knee band, the free end threaded through a "D"-ring secured to the left knee band, then through a "D"-ring secured to the waist belt at a medial position between the ends of the waist belt, then through a "D"-ring secured to the right knee band and then through a buckle secured to the waist belt above the right knee band.

2. The exercise harness according to claim 1 further including a chest strap extending between the two shoulder straps sized and configured to be adjacent the chest of a user.

3. The exercise harness according to claim 1 further including a pair of "D"-rings for connecting the shoulder straps to the unweighting system.

4. The exercise harness according to claim 1 further including means for securing the "D"-rings on the shoulder straps at a preselected position on the shoulder straps.

5. The exercise harness according to claim 1 further including a gait strap adapted to wrap partially around a leg of a user, the strap having one end secured to the waist belt and the other end secured to one of the knee bands.

* * * * *